US010219080B2

(12) United States Patent
Shan et al.

(10) Patent No.: US 10,219,080 B2
(45) Date of Patent: Feb. 26, 2019

(54) ELECTRICAL-ACOUSTIC TRANSFORMATION DEVICE

(71) Applicant: Goertek, Inc., Weifang, Shandong (CN)

(72) Inventors: Lianwen Shan, Weifang (CN); Xinfeng Yang, Weifang (CN); Hairong Wang, Weifang (CN); Longhao Cui, Weifang (CN)

(73) Assignee: GOERTEK, INC., Shandong (CN)

( * ) Notice: Subject to any disclaimer, the term of this patent is extended or adjusted under 35 U.S.C. 154(b) by 0 days.

(21) Appl. No.: 15/552,707

(22) PCT Filed: Dec. 9, 2015

(86) PCT No.: PCT/CN2015/096865

§ 371 (c)(1),
(2) Date: Aug. 22, 2017

(87) PCT Pub. No.: WO2016/184080

PCT Pub. Date: Nov. 24, 2016

(65) Prior Publication Data

US 2018/0035213 A1 Feb. 1, 2018

(30) Foreign Application Priority Data

May 21, 2015 (CN) ..... 2015 1 0263321

(51) Int. Cl.
*H04R 9/02* (2006.01)
*H04R 1/22* (2006.01)
(Continued)

(52) U.S. Cl.
CPC ..... *H04R 23/02* (2013.01); *H04R 1/22* (2013.01); *H04R 9/025* (2013.01); *H04R 9/06* (2013.01);
(Continued)

(58) Field of Classification Search
CPC ..... H04R 23/02; H04R 1/22; H04R 9/025; H04R 9/06; H04R 19/02; H04R 31/003;
(Continued)

(56) References Cited

U.S. PATENT DOCUMENTS

2015/0010173 A1 1/2015 Bernal Castillo et al.

FOREIGN PATENT DOCUMENTS

CN 201533406 U 7/2010
CN 101998216 A * 3/2011
(Continued)

OTHER PUBLICATIONS

Wang, Z "Electroacoustic Transducer" Dec. 5, 2012, V06-V01A1.*

*Primary Examiner* — Sunita Joshi
(74) *Attorney, Agent, or Firm* — Hultquist, PLLC; Steven J. Hultquist

(57) ABSTRACT

Disclosed is an electrical-acoustic transformation device, including: a vibration system and a magnetic circuit system with a magnetic gap; wherein the vibration system includes: a diaphragm, a voice coil provided below the diaphragm and suspending in the magnetic gap, a piezoelectric plate provided on one side of the diaphragm, a first frequency division circuit connected to the voice coil, and a second frequency division circuit connected to the piezoelectric plate; and the first frequency division circuit performs frequency division on an externally input first audio signal and outputs same to the voice coil; and the second frequency division circuit performs frequency division on an externally input second audio signal to obtain a high frequency signal to drive the piezoelectric plate. The present invention provides an electrical-acoustic transformation device with super wideband.

8 Claims, 3 Drawing Sheets

(51) Int. Cl.

| | |
|---|---|
| ***H04R 9/06*** | (2006.01) |
| ***H04R 23/02*** | (2006.01) |
| ***H04R 19/02*** | (2006.01) |
| ***H04R 31/00*** | (2006.01) |

(52) U.S. Cl.
CPC ..... *H04R 19/02* (2013.01); *H04R 31/003* (2013.01); *H04R 2209/024* (2013.01); *H04R 2400/11* (2013.01)

(58) Field of Classification Search
CPC ..... H04R 2209/024; H04R 2400/11; H04R 9/04; H04R 9/05; B06B 1/0292; B06B 1/045; B06B 1/0648
See application file for complete search history.

(56) References Cited

FOREIGN PATENT DOCUMENTS

| | | | | |
|---|---|---|---|---|
| CN | 102281488 | A | | 12/2011 |
| CN | 102811410 | A | * | 12/2012 |
| CN | 102811410 | A | | 12/2012 |
| CN | 203968363 | U | * | 11/2014 |
| CN | 104902393 | A | | 9/2015 |
| CN | 204652640 | U | | 9/2015 |
| JP | 63279700 | A | | 11/1988 |

* cited by examiner

ELECTRICAL-ACOUSTIC TRANSFORMATION DEVICE

CROSS-REFERENCE TO RELATED APPLICATIONS

This application is a U.S. national phase under the provisions of 35 U.S.C. § 371 of International Patent Application No. PCT/CN2015/096865 filed Dec. 9, 2015, which in turn claims priority of Chinese Patent Application No. 201510263321.5 filed May 21, 2015. The disclosures of such international patent application and Chinese priority patent application are hereby incorporated herein by reference in their respective entireties, for all purposes.

TECHNICAL FIELD

The present invention relates to an electrical-acoustic transformation device.

BACKGROUND

Ordinary moving coil receivers and speakers are referred to as moving coil electrical-acoustic transformation devices. No matter if it is applied to a mobile phone or an earphone, rapid drop will occur in the high frequency response curve of the receiver at 6 k-9 kHz, and in the high frequency response curve of the speaker after 10 KHz, which is the so-called high frequency cutoff frequency. Due to the limitations of the material and process of the moving coil electrical-acoustic transformation device, it is hard to increase the high frequency cutoff frequency.

With the application of 4G communications, super wideband electrical-acoustic transformation devices are required. The high frequency cutoff frequency is required to be up to 16 kHz and higher. Thus, the existing moving coil electrical-acoustic transformation device meet realize these requirements.

SUMMARY

An object of the present invention is to provide a new technical solution of an electrical-acoustic transformation device with super wideband.

The present invention provides an electrical-acoustic transformation device, including: a vibration system and a magnetic circuit system with a magnetic gap; wherein the vibration system includes: a vibrating diaphragm, a voice coil provided below the vibrating diaphragm and suspending in the magnetic gap, a piezoelectric plate provided on one side of the vibrating diaphragm, a first frequency division circuit connected to the voice coil, and a second frequency division circuit connected to the piezoelectric plate; and the first frequency division circuit performs frequency division on an externally input first audio signal and outputs same to the voice coil; and the second frequency division circuit performs frequency division on an externally input second audio signal to obtain a high frequency signal to drive the piezoelectric plate.

Preferably, the first frequency division circuit is a low pass filter and the second frequency division circuit is a high pass filter.

Preferably, the vibrating diaphragm includes a planar portion located in the center and a surround portion located at an edge of the planar portion and the piezoelectric plate is provided at the location of the planar portion of the vibrating diaphragm.

Preferably, the vibration system further includes a spider fixed to the voice coil, the spider includes a first conductive line and a second conductive line formed on an surface thereof, the externally first audio signal is input to the first frequency division circuit via the first conductive line, and the externally input second audio signal is input to the second frequency division circuit via the second conductive line.

Preferably, the first frequency division circuit and the second frequency division circuit are provided on the surface of the spider.

Preferably, the first frequency division circuit is provided on the surface of the spider and the second frequency division circuit is provided on the surface of the piezoelectric plate.

Preferably, the arrangement of the vibration system is any one of the following: the piezoelectric plate, the spider, the vibrating diaphragm, and the voice coil successively from top to bottom; or the vibrating diaphragm, the piezoelectric plate, the spider, and the voice coil successively from top to bottom; or the piezoelectric plate, the vibrating diaphragm, the spider, and the voice coil successively from top to bottom.

Preferably, the spider is provided with two second pads electrically connected to the piezoelectric plate on an upper surface of the spider, and is provided with two first pads electrically connected to the voice coil on a lower surface thereof.

Preferably, the center of the vibrating diaphragm is provided with an opening, the spider includes a center portion, an outer ring, and a connection portion connected to the center portion and outer ring, and the first pads and the second pads are provided at the center portion of the spider.

The inventors of the present invention have found that there is no electrical-acoustic transformation device with super wideband combined with a moving coil sound generating structure in the prior art. Thus, the technical task to be realized by the present invention or the technical problem to be solved is not contemplated or predicted by those skilled in the art, so the present invention is a new technical solution.

The electrical-acoustic transformation device in the present invention has a moving coil sound generating structure and a piezoelectric sound generating structure and is provided with two frequency division circuits. The piezoelectric plate drives the diaphragm to vibrate and sound when a high frequency signal is input to the piezoelectric plate. The voice coil drives the diaphragm to vibrate and sound under the action of a magnetic field when a low frequency signal is input to the voice coil, thus realizing an electrical-acoustic transformation device with good performance and super wideband.

The other features and advantages of the present invention will become clear according to the detailed description of exemplary embodiments of the present invention with reference to the accompanying drawings.

BRIEF DESCRIPTION OF THE DRAWINGS

The figures incorporated in the description and forming a part of the description illustrate the embodiments of the present invention and used to explain the principle of the present invention along therewith.

REFERENCE SIGNS

Figure 1:
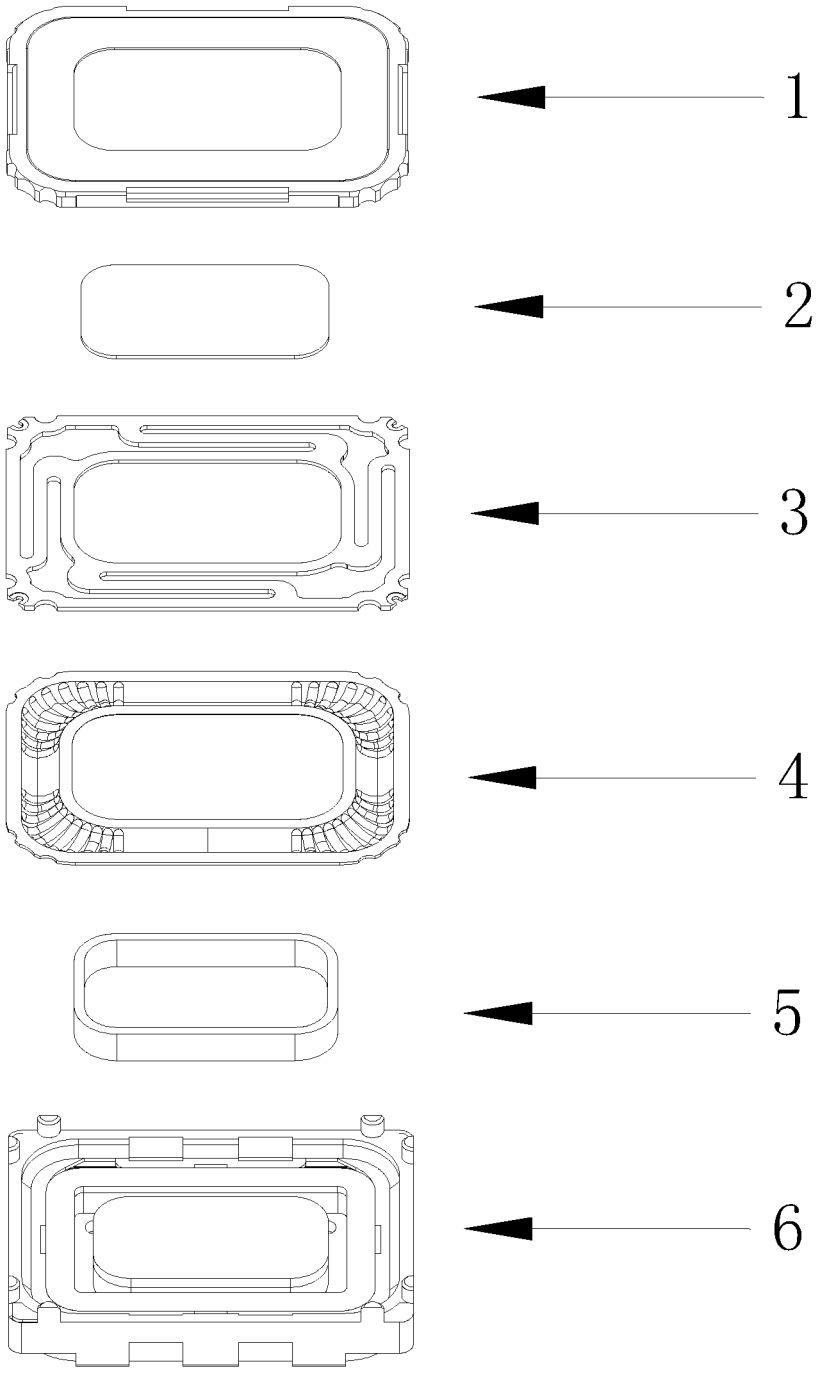
FIG. 1 is a structure view of an electrical-acoustic transformation device in the present invention.

1 front cover, 2 piezoelectric plate, 3, spider, 4 diaphragm, 5 voice coil, 6 frame and magnetic circuit system, 301 center portion, 302 outer ring, 303 suspension arm, 100 low pass filter, 200 high pass filter, 31 pad, 33 pad, 32 first pad, 34 second pad.

DETAILED DESCRIPTION

Various exemplary embodiments of the present invention will be described in detail with reference to the accompanying drawings. It should be noted that unless stated specifically otherwise, the relative arrangement of the components and steps illustrated in these embodiments, the numeral expressions and the values do not limit the scope of the present invention.

The description of at least one exemplary embodiment of the present invention is actually merely illustrative rather than limiting the present invention and the application or use thereof.

Technologies, methods and devices known to those skilled in the art may not be described in detail, but when appropriate, the technologies, methods and devices shall be regarded as a part of the description.

Any particular value in all examples illustrated and described here shall be construed as merely illustrative rather than limiting. Thus, other examples of the exemplary embodiments may have different values.

It should be noted that similar signs and letters represent similar items in the following figures, and thus, once a certain item is defined in a figure, there is no need to further describe the same in the following figures.

An embodiment of the present invention provides an electrical-acoustic transformation device, where the device includes: a vibration system, a magnetic circuit system and a housing for accommodating and fixing the vibration system and the magnetic circuit system. The magnetic circuit system includes a washer, a magnet, a frame and so on fixed successively from top to bottom. The magnet may include a center magnet and an edge magnet. Accordingly, the washer may include a center washer and an edge washer. The gap between the center magnet and the edge magnet is the magnetic gap. Of course, the structure of the magnetic circuit system and the provision of the magnetic gap may also be realized otherwise and those skilled in the art may design the same according to the prior art and the requirements of the application environment. The vibration system includes: a diaphragm, a voice coil provided below the diaphragm and suspending in the magnetic gap, and a piezoelectric plate provided on one side of the diaphragm.

The vibration system also includes a first frequency division circuit connected to the voice coil and a second frequency division circuit connected to the piezoelectric plate. The purpose of frequency division is to divide the high frequency component and the low frequency component of the signal. The first frequency division circuit performs frequency division on an externally input first audio signal and outputs the same to the voice coil. The second frequency division circuit performs frequency division on an externally input second audio signal to obtain a high frequency signal to drive the piezoelectric plate. The sources of two audio signals are the same, but the power of the second audio signal will be bigger after passing through a power amplification circuit. The first frequency division circuit may be for example a low pass filter and the second frequency division circuit may be for example a high pass filter.

By means of the above structure, the combination of a moving voice coil sound generating device and a piezoelectric sound generating device is realized. The high frequency cutoff frequency of the piezoelectric sound generating device may be up to 16 kHz and higher. By means of providing the above frequency division circuit, the piezoelectric plate drives the diaphragm to vibrate and sound when a high frequency signal is input to the piezoelectric plate. The voice coil drives the diaphragm to vibrate and sound under the action of a magnetic field when a low frequency signal is input to the voice coil, thus realizing an electrical-acoustic transformation device with good performance and super wideband.

In addition, the piezoelectric plate may be placed at the center location of the diaphragm such that the piezoelectric plate can function as a diaphragm reinforcement portion or DOME. For example, the diaphragm may include a planar portion located at the center and a surround portion located at the edge of the planar portion. The piezoelectric plate is placed at the location of the planar portion of the diaphragm.

An embodiment of the electrical-acoustic transformation device in the present invention is shown in FIGS. 1 to 4, including the followings successively from top to bottom: a front cover 1, a piezoelectric plate 2, a spider 3, a diaphragm 4, a voice coil 5, a frame and magnetic circuit system 6.

The magnetic circuit system has a magnetic gap. The front cover 1 and the frame form a housing for accommodating and fixing the vibration system and the magnetic circuit system. The magnetic circuit system and the frame are integrally shown in FIG. 1 schematically.

The piezoelectric plate 2, the spider 3, the diaphragm 4, and the voice coil 5 form the vibration system. It can be seen from FIG. 1 that the diaphragm includes a planar portion located at the center, a surround portion located at the edge of the planar portion and a fixation portion located at the outermost and fixed to the housing. The piezoelectric plate 2 is provided above the planar portion of the diaphragm. The planar portion of the diaphragm forms a through opening at the location corresponding to the piezoelectric plate by means of material removal. The piezoelectric plate covers the opening and is combined with the diaphragm. The piezoelectric plate so provided can function as a diaphragm reinforcement or DOME. FIG. 1 is an exploded view. After being assembled, the voice coil will be suspended in the magnetic gap of the magnetic circuit system.

Figure 2:
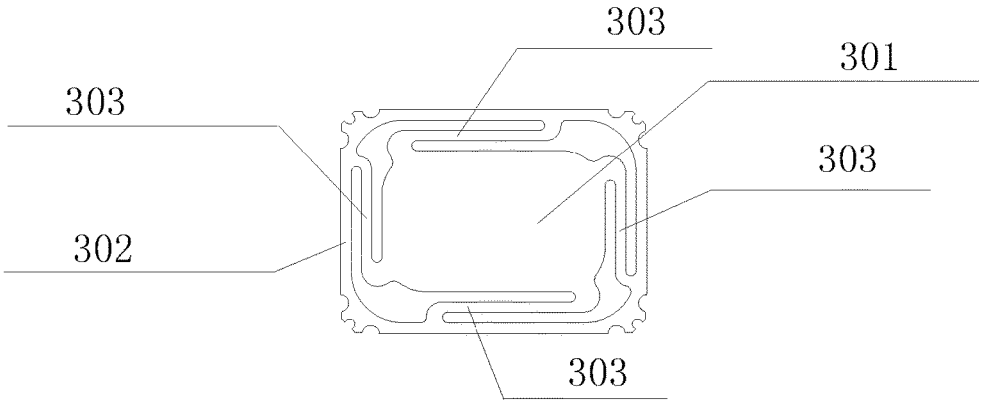
FIG. 2 is a structure view of a spider in the present invention.

FIG. 2 shows a schematic structure of the spider 3. The spider 3 includes an outer ring 302 and a center portion 301 located at the center. The center portion 301 and the outer portion 302 are connected through 4 suspension arms 303 (connection portions).

Figure 3:
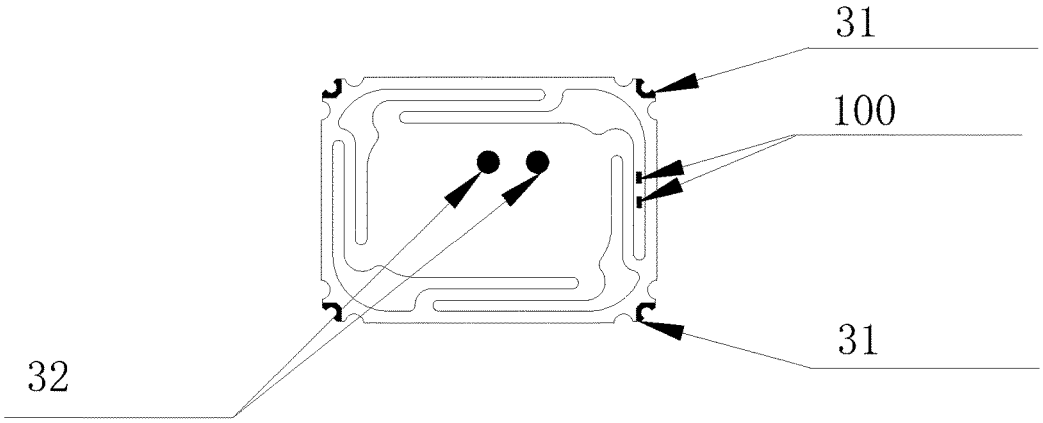
FIG. 3 is a structure view of providing a first conductive line and a first frequency division circuit on a lower surface of the spider.

FIG. 3 shows a lower surface of the spider 3. The lower surface is provided with a first conductive line (not shown), a first-order low pass filter 100 formed by an inductor and a load resistor, two pads 31 located at the corners of the outer ring and two first pads 31 located at the center portion. The first conductive line is electrically connected to an external circuit through the pads 31 to access a first audio signal. The first audio signal is filtered by the first-order low pass filter 100 to obtain a low frequency signal. The low frequency signal is output by the first pads 32 to the voice coil 5.

Figure 4:
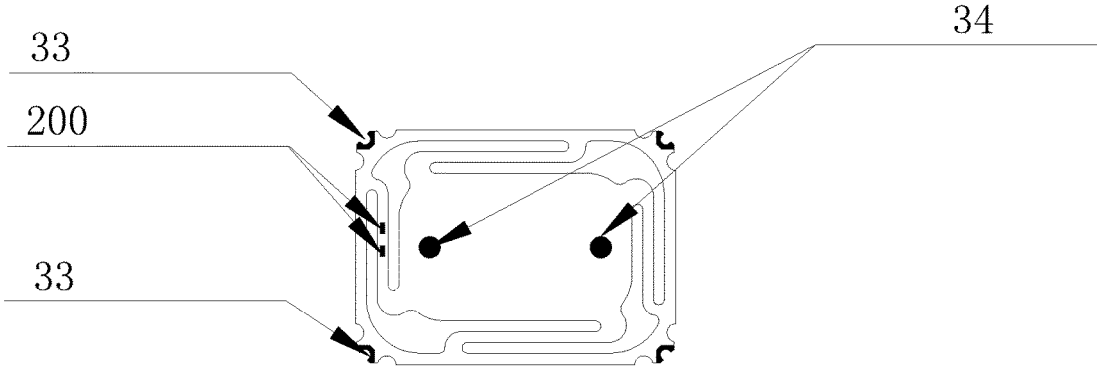
FIG. 4 is a structure view of providing a second conductive line and a second frequency division circuit on an upper surface of the spider.

FIG. 4 shows an upper surface of the spider 3. The upper surface of the spider 3 is provided with a second conductive line (not shown), a first-order high pass filter 200 formed by a capacitor and a load resistor, two pads 33 located at another two corners of the outer ring and two second pads 34 located at the center portion. The second conductive line is electrically connected to an external circuit through the pads 33 to access a second audio signal. The second audio signal is filtered by the first-order high pass filter 200 to obtain a high frequency signal. The high frequency signal is output by the two second pads 34 to the piezoelectric plate 2.

Figure 5:
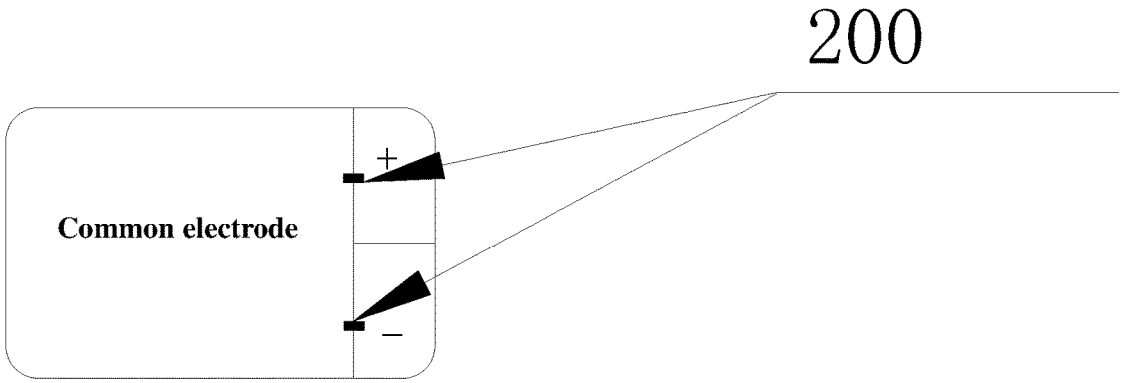
FIG. 5 is a structure view of providing a second frequency division circuit on a piezoelectric plate.

In another embodiment, the second frequency division circuit may also be provided on the piezoelectric plate 2. As shown in FIG. 5, the first-order high pass filter 200 formed by a capacitor and a load resistor is provided on the piezoelectric plate 2. The second conductive line on the spider 3 is electrically connected to an external circuit through the pads 33 to access a second audio signal. The second audio signal is output to the first-order high pass filter 200 through the pads 34 and filtered to obtain a high frequency signal. The high frequency signal drives the piezoelectric plate to vibrate.

In the above embodiments, the arrangement method of the vibration system is the piezoelectric plate, the spider, the diaphragm, and the voice coil successively from top to bottom. Or, the arrangement method of the vibration system is the diaphragm, the piezoelectric plate, the spider, and the voice coil successively from top to bottom. Or, the arrangement method of the vibration system is the piezoelectric plate, the diaphragm, the spider, and the voice coil successively from top to bottom. In these arrangement methods, the spider is located between the piezoelectric plate and the voice coil. The spider can be used to place the conductive lines and the frequency division circuits. Since the center of the diaphragm is provided with an opening, the second pads connected to the piezoelectric plate may be provided on the upper surface of the center portion of the spider, and the lower surface of the center portion may be provided with the first pads connected to the voice coil. Such a connection method has no obstacles and the connection lines are short and easy to realize.

The electrical-acoustic transformation device in an embodiment of the present invention has a moving coil sound generating structure and a piezoelectric sound generating structure and is provided with two frequency division circuits. The piezoelectric plate drives the diaphragm to vibrate and sound when a high frequency signal is input to the piezoelectric plate. The voice coil drives the diaphragm to vibrate and sound under the action of a magnetic field when a low frequency signal is input to the voice coil, thus realizing an electrical-acoustic transformation device with good performance and super wideband. The electrical-acoustic transformation device in an embodiment of the present invention can arrange the conductive lines and frequency division circuits using the piezoelectric plate, thus the wiring is delicate and easy to realize.

Although some specific embodiments of the present invention have been described in detail by way of example, it should be understood by those skilled in the art that the above examples are merely for the sake of description rather than limiting the scope of the present invention. It should be understood by those skilled that the above embodiments may be modified without departing from the scope and spirit of the present invention. The scope of the present invention is limited by the appended claims.

The invention claimed is:

1. An electrical-acoustic transformation device, comprising:

a vibration system and a magnetic circuit system with a magnetic gap;

wherein the vibration system includes: a diaphragm, a voice coil provided below the diaphragm and suspending in the magnetic gap, a piezoelectric plate provided on one side of the diaphragm, a first frequency division circuit connected to the voice coil, a second frequency division circuit connected to the piezoelectric plate, and a spider fixed to the voice coil, the spider including a first conductive line and a second conductive line formed on a surface thereof; and the first frequency division circuit performs frequency division on an externally input first audio signal and outputs the same to the voice coil, with the externally input first audio signal being input to the first frequency division circuit via the first conductive line; and the second frequency division circuit performs frequency division on an externally input second audio signal to obtain a high frequency signal to drive the piezoelectric plate, with the externally input second audio signal being input to the second frequency division circuit via the second conductive line.

2. The device according to claim 1, wherein the first frequency division circuit is a low pass filter and the second frequency division circuit is a high pass filter.

3. The device according to claim 1, wherein the diaphragm includes a planar portion located in the center and a surround portion located at an edge of the planar portion, and the piezoelectric plate is provided at the location of the planar portion of the diaphragm.

4. The device according to claim 1, wherein the first frequency division circuit and the second frequency division circuit are provided on the surface of the spider.

5. The device according to claim 1, wherein the first frequency division circuit is provided on the surface of the spider and the second frequency division circuit is provided on a surface of the piezoelectric plate.

6. The device according to claim 1, wherein the arrangement of the vibration system is any one of the following: the piezoelectric plate, the spider, the diaphragm, and the voice coil successively from top to bottom; or the diaphragm, the piezoelectric plate, the spider, and the voice coil successively from top to bottom; or the piezoelectric plate, the diaphragm, the spider, and the voice coil successively from top to bottom.

7. The device according to claim 6, wherein the spider is provided with two second pads electrically connected to the piezoelectric plate on an upper surface of the spider and is provided with two first pads electrically connected to the voice coil on a lower surface thereof.

8. The device according to claim 7, wherein the center of the diaphragm is provided with an opening, the spider includes a center portion, an outer ring, and a connection portion connected to the center portion and the outer ring, and the first pads and the second pads are provided at the center portion of the spider.

* * * * *